United States Patent [19]

Kamei et al.

[11] Patent Number: 4,546,074

[45] Date of Patent: Oct. 8, 1985

[54] SILVER HALIDE COLOR LIGHT-SENSITIVE MATERIALS

[75] Inventors: Sadao Kamei; Yuichi Ohashi; Toshinao Ukai; Kiyohiko Yamamuro; Haruo Takei, all of Kanagawa, Japan

[73] Assignee: Fuji Photo Film Co., Ltd., Kanagawa, Japan

[21] Appl. No.: 539,240

[22] Filed: Oct. 5, 1983

[30] Foreign Application Priority Data

Oct. 5, 1982 [JP] Japan ..... 57-175198

[51] Int. Cl.[4] ..... G03C 1/02

[52] U.S. Cl. ..... 430/573; 430/575; 430/576; 430/577; 430/592

[58] Field of Search ..... 430/573, 574, 575, 576, 430/577, 578, 592

[56] References Cited

U.S. PATENT DOCUMENTS

| | | | |
|---|---|---|---|
| 2,704,714 | 3/1955 | Carroll et al. | 430/573 |
| 3,432,302 | 3/1969 | Jones et al. | 430/573 |
| 3,864,134 | 2/1975 | Ueda et al. | 430/575 |

*Primary Examiner*—J. Travis Brown

*Attorney, Agent, or Firm*—Sughrue, Mion, Zinn, Macpeak & Seas

[57] ABSTRACT

A silver halide color light sensitive material with a silver iodobromide photographic emulsion layer is described. The silver iodobromide photographic emulsion contains at least one compound represented by the general formula (I):

(I)

and at least one compound represented by the general formula (II):

(II)

(in the general formulae (I) and (II), all symbols are as defined in the appended claims). The surface of silver iodobromide grains of the surface low iodine content type in the photographic emulsion is adsorbed from $10^{-7}$ to $10^{-3}$ mol of iodide ion per mol of silver halide. The silver iodobromide emulsion is spectrally sensitized in a red region without causing any undesirable problems.

14 Claims, No Drawings

SILVER HALIDE COLOR LIGHT-SENSITIVE MATERIALS

FIELD OF THE INVENTION

The present invention relates to silver halide color light-sensitive materials and, more particularly, to silver halide color light-sensitive materials which are improved in red-sensitivity.

BACKGROUND OF THE INVENTION

In general, thiacarbocyanines and selenacarbocyanines have been used as sensitizing dyes for the red-sensitivity of silver halide color light-sensitive materials (hereinafter sometimes referred to as "color light-sensitive materials"). The use of such sensitizing dyes in combination results in the production of color light-sensitive materials having increased sensitivity to red light.

These sensitizing dyes, however, have disadvantages in that color reproduction of red and green is poor because they have a broad spectral sensitivity distribution and are somewhat sensitive to green light.

Thiacarbocyanine is strongly adsorbed on silver halide, giving rise to problems in that it decreases the intrinsic sensitivity of silver halide and tends to inhibit an increase in sensitivity during the processing of development, particularly at the stage of pushed development generally called "sensitizing treatment".

The absorption peak of spectral sensitization of a system in which the foregoing sensitizing dyes are used in combination is in the region of 655 to 660 nm, which is longer than that for the preferred absorption peak of spectral sensitization. From a viewpoint of color reproduction, therefore, it has been desired to discover sensitizing dyes producing the absorption peak in a region which is 5 to 10 nm shorter than the foregoing region.

However, when the chemical structure of the spectral sensitizing dye is slightly changed in order to shift the absorption peak of spectral sensitization to the preferred region by only about 5 to 10 nm, various problems are often involved, including a serious change in sensitivity, changes in rate of development, and adverse influences on storage properties.

The use of thiacarbocyanine or selenacarbocyanine in combination with holopolar cyanine is known as described in, for example, U.S. Pat. Nos. 2,704,718 and 3,547,623. However, even if they are used in combination with each other, no sufficient sensitivity can be obtained and color reproduction in the red-sensitive region is insufficient.

SUMMARY OF THE INVENTION

An object of the invention is to provide silver halide color light-sensitive materials, particularly silver iodobromide/gelatin photographic light-sensitive materials whose spectral sensitization in the red region can be set to a preferred wavelength region without causing the above-described disadvantages.

In accordance with the present invention, it has been found that in spectral sensitization of a silver iodobromide photographic emulsion in the red region, the use of color light-sensitive materials as described hereinafter makes it possible to obtain a high red-sensitivity which is substantially constant.

The present invention relates to a silver halide color light-sensitive material prepared using a silver iodobromide photographic emulsion, which is characterized in that the silver iodobromide photographic emulsion contains at least one compound represented by the general formula (I) and at least one compound represented by the general formula (II), the general formulae (I) and (II) being described hereinafter, and in that on the surface of silver iodobromide particles of the surface low iodine content type in the photographic emulsion is adsorbed from $10^{-7}$ to $10^{-3}$ mol of iodide ion per mol of silver halide.

DETAILED DESCRIPTION OF THE INVENTION

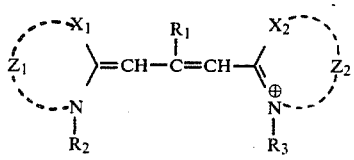

(I)

wherein $X_1$ and $X_2$ are each a sulfur atom or a selenium atom; $Z_1$ and $Z_2$ are each a non-metal atom group necessary for forming a benzene ring or a naphthalene ring; $R_1$ is a hydrogen atom, an alkyl group containing 6 or less carbon atoms, an aralkyl group containing 12 or less carbon atoms, or a phenyl group; and $R_2$ and $R_3$ are each an alkyl group containing 10 or less carbon atoms, or an alkyl group containing 10 or less carbon atoms which is substituted by a sulfo group, a hydroxyl group, a carboxyl group, a carbamoyl group, an alkoxy group, a phenyl group, a sulfophenyl group, a carboxyphenyl group, or a halogen atom, and at least one of $R_2$ and $R_3$ contains a sulfo group or a carboxyl group.

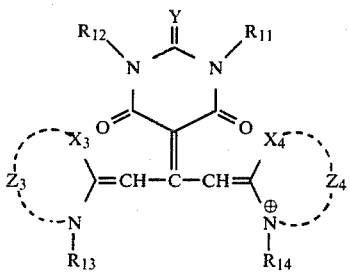

(II)

wherein Y is an oxygen atom or a sulfur atom; $X_3$ and $X_4$ are each a sulfur atom or a selenium atom; $Z_3$ and $Z_4$ are each a non-metal atom group necessary to form a benzene ring or a naphthalene ring; $R_{11}$ and $R_{12}$ are each an alkyl group containing 6 or less carbon atoms, or an alkyl group containing 6 or less carbon atoms which is substituted by an alkoxyl group containing from 1 to 4 carbon atoms, a chlorine atom, a fluorine atom, or a phenyl group; and $R_{13}$ and $R_{14}$ are each an alkyl group containing 10 or less carbon atoms, or an alkyl group containing 6 or less carbon atoms which is substituted by a sulfo group, a hydroxyl group, a carboxyl group, a carbamoyl group, an alkoxy group, a phenyl group, a sulfophenyl group, a carboxyphenyl group, or a halogen atom.

In the present invention, when the amount of iodide ion being added is increased (for example, 1 mol% per mol of silver halide), various problems arise; for example, the intrinsic desensitization of silver halide particles is increased, giving rise to the problems that even after color sensitization the sensitivity decreases, and the rate of development of silver halide particles is reduced. On the other hand, when the amount of iodide ion being added is too small, adsorption of the sensitizing dye is insufficiently accelerated and, in some cases, the desired high red-sensitivity can be obtained only with difficulty. Accordingly, it is preferred that the amount of iodide ion being added should be chosen within the range that eliminates the above-described problems. Thus, the amount of iodide ion being adsorbed per mol of silver halide is from $10^{-7}$ to $10^{-3}$ mol, preferably from $10^{-6}$ to $10^{-3}$ mol and most preferably from $10^{-6}$ to $10^{-4}$ mol.

In the present invention, the order of adding the compounds of the general formulae (I) and (II), and iodide ion is not critical. Although they may be added at the same time, it is preferred that the iodide ion is firstly added to the surface low iodine content type silver iodobromide emulsion and, then, the compounds of the general formulae (I) and (II) are added to the silver iodobromide emulsion. The compounds of the general formulae (I) and (II) may be added at the same time, or may be added in a manner that one of the compounds of the general formulae (I) and (II) is firstly added to the silver iodobromide emulsion and then another is added thereto, as described hereinafter. It is particularly preferred that the iodide ion, the compound of the general formula (I), and the compound of the general formula (II) be added in the sequence. The addition of the iodide ion and the compounds of the general formulae (I) and (II) to the silver halide emulsion is usually carried out under condition at 30° C. to 80° C.

In addition, there may be employed a procedure in which an iodide ion compound and a bromide ion compound are mixed to form an aqueous solution, and the aqueous solution is then added to a sol-like silver iodobromide emulsion. An iodide ion-containing aqueous solution is added to the emulsion and fully stirred. It is considered that substantially almost all iodide ions added are immediately adsorbed on silver iodobromide emulsion particles.

In the silver iodobromide emulsion, as a matter of course, the iodide ion is incorporated in the particle thereof as a mixed crystal and, therefore, it is naturally assumed that some iodide ions are present on the particle surface. Despite this assumption, supply and adsorption of additional iodide ions on the particle produce the above-described spectral sensitization effect. This is an unexpected and astonishing discovery.

Heretofore, it has generally been known that in the spectral sensitization of silver halide photographic emulsions, iodide ions are added in combination with spectral sensitizing dyes.

Many cyanine dyes commonly used as spectral sensitizing dyes are cationic dyes. In the case of dyes containing iodide ions as counter ions, the iodide ions are unintentionally added to photographic emulsions in combination with dye cations and are adsorbed on silver halide particles. In this case, however, the amount (expressed in mols) of iodide ions is equal to the amount (expressed in mols) of dye; i.e., equimolar amounts of iodide ion and dye are added. Thus, the effect of the invention as obtained by changing the amount of iodide ions cannot be obtained. On the other hand, in the case of cyanine dyes of the anion type, it is not possible to add iodide ions unintentionally.

It is also known, as described in Japanese Patent Publication No. 46932/74, that spectral sensitization can be advantageously achieved by adding iodide ions to silver chlorobromide and allowing them to be adsorbed thereon. As described hereinbefore, however, it is not possible for one skilled in the art to predict or determine that the same technique is applicable to the system of silver iodobromide.

In accordance with the present invention, reproduction of red color is greatly improved; in other words, color-mixing is reduced and color separation is improved. In addition, the reproduction of yellowish green (e.g., yellow green) is improved; in particular, the reproduction of cyan green is improved.

The term "surface low iodine content type emulsion" as used herein means an emulsion comprising silver iodobromide grains in which the iodine content of the surface portion of the silver iodobromide grain is lower than that of the inner portion thereof. In more detail, the surface low iodine type silver iodobromide is a silver iodobromide emulsion which has the iodine content (as a whole of grains) of from 1 to 10 mol%, which has a peak attributable to a low iodine content layer as determined by X-ray diffractiometry, and of which the surface iodine content as determined by the XPS process (X-ray photoelectronic spectrometry) is from 0.5 to 8 mol%. A preferred surface low iodine type silver iodobromide is such that the iodine content (as a whole of grains) is from 1.5 to 5 mol%, there are two peaks, as determined by X-ray diffractiometry, attributable to high iodine content and low iodine content layers, and the surface iodine content as determined by the XPS process is from 1 to 3.5 mol%.

The XPS process is a well known procedure, which makes it possible to easily determine the iodine content. This XPS process is described in detail in P. M. Kelly & M. G. Mason, *J. Appl. Physics.*, 47 (11), 4721–4725 (1976).

Silver halide grains contained in the surface low iodine content type photographic emulsion of the invention may have a regular crystal form, e.g., cubic and octahedral forms, an irregular crystal form, e.g., spherical and plate-like forms, or a composite form thereof. In addition, they may be a mixture of grains having various kinds of crystal forms.

Silver halide grains may be different in phase between the inner and surface portions thereof. In addition, there may be those grains in which a latent image is formed mainly on the surface thereof, or those grains in which a latent image is formed mainly in the inner portion thereof.

These grains are of the so-called core-shell type, and a method of preparation thereof is known. For example, they can be prepared by reference to U.S. Pat. No. 3,206,313.

Usual grains which are not of the core-shell type can also be easily prepared by the single jet method or double jet method (e.g., a control double jet method) in which silver iodide grains are formed in a relatively large amount at the initial stage thereof. For example, in the double jet method, iodide ions are placed in a reactor, and silver and bromide ions are added thereto at the same time to form halide grains.

The mean grain size of the silver halide grains is preferably from 0.1 to 2.0$\mu$ and more preferably from 0.2 to 1.5$\mu$.

Photographic emulsions can be easily prepared by reference to, for example, P. Glafkides, *Chimie et Physique Photographique,* Paul Montel Co. (1967), G. F. Duffin, *Photographic Emulsion Chemistry,* The Focal Press Co. (1966), and V. L. Zelikman et al., *Making and Coating Photographic Emulsion,* The Focal Press Co. (1964).

In the red-sensitive layer of the silver halide color light-sensitive material of the invention, the surface low iodine type silver iodobromide is used in a proportion of preferably at least 50% by weight and more preferably at least 60% by weight. When there are two or more red-sensitive layers, it is preferred that at least one of the layers contains the surface low iodine type silver iodobromide.

The compounds represented by the general formulae (I) and (II) will hereinafter be explained.

The benzene or naphthalene ring represented by each of $Z_1$, $Z_2$, $Z_3$ and $Z_4$ in the general formulae (I) and (II) may be substituted by a chlorine atom, a bromine atom, a lower alkyl group containing from 1 to 7 carbon atoms, a lower alkoxy group containing from 1 to 6 carbon atoms, a carboxyl group, a hydroxyl group, an alkoxycarbonyl group containing from 2 to 5 carbon atoms in total, an acylamino group wherein the number of carbon atoms in the acyl moiety being from 2 to 5, or a phenyl group. The phenyl group may be substituted by a chlorine atom, a bromine atom, an alkyl group containing 4 or less carbon atoms, or an alkoxy group containing 4 or less carbon atoms.

Preferred compounds represented by the general formula (I) can be represented by the general formula (III):

(III)

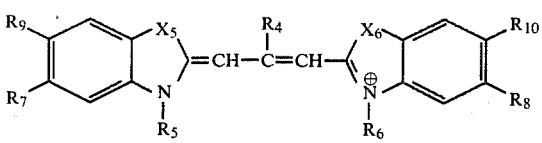

wherein $X_5$ and $X_6$ may be the same or different, and are each a sulfur atom or a selenium atom;

$R_4$ is an ethyl group, a propyl group, a butyl group, or a phenethyl group;

$R_5$ and $R_6$ are each a sulfoalkyl group containing from 2 to 4 carbon atoms, a carboxyalkyl group containing from 2 to 5 carbon atoms, a hydroxyalkyl group containing from 2 to 6 carbon atoms, an unsubstituted carbamoylalkyl group containing from 2 to 5 carbon atoms, or a lower alkyl group containing 6 or less carbon atoms (which may be substituted by a fluorine atom, a chlorine atom, an alkoxy group containing from 1 to 4 carbon atoms, a phenyl group, a sulfophenyl group, or a carboxyphenyl group), and at least one of $R_5$ and $R_6$ is a group containing a sulfo group or a carboxyl group;

$R_7$ and $R_8$ are each a hydrogen atom, a chlorine atom, a bromine atom, a lower alkyl group containing from 1 to 7 carbon atoms, a lower alkoxy group containing from 1 to 6 carbon atoms, a carboxyl group, a hydroxyl group, an alkoxycarbonyl group containing from 2 to 5 carbon atoms in total, an acylamino group wherein the number of carbon atoms in the acyl moiety being from 2 to 5, or a phenyl group (which may be substituted by a chlorine atom, a bromine atom, an alkyl group containing 4 or less carbon atoms, or an alkoxy group containing 4 or less carbon atoms);

$R_9$ and $R_{10}$ are each a hydrogen atom, a chlorine atom, a bromine atom, a lower alkyl group containing from 1 to 7 carbon atoms, a lower alkoxy group containing from 1 to 6 carbon atoms, a hydroxyl group, or an acylamino group wherein the number of carbon atoms in the acyl moiety being from 2 to 5.

Preferred compounds represented by the general formula (II) can be represented by the general formulae (IV) and (V):

(IV)

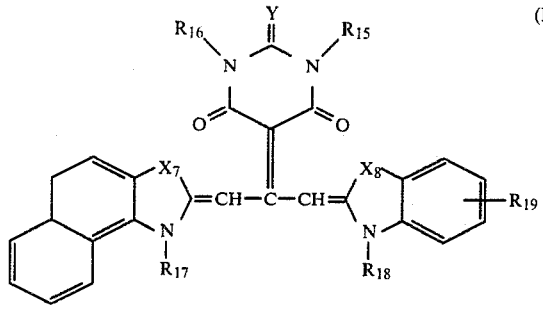

(V)

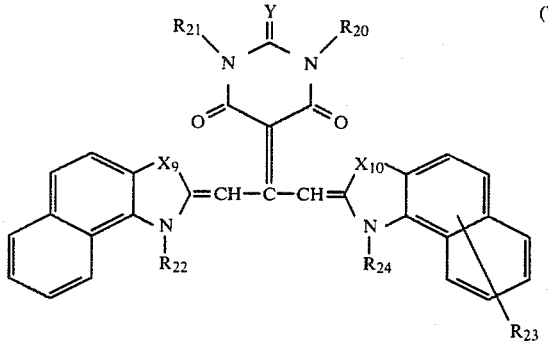

wherein

Y is an oxygen atom or a sulfur atom, preferably an oxygen atom;

$R_{15}$, $R_{16}$, $R_{20}$ and $R_{21}$ are each a lower alkyl group containing from 1 to 6 carbon atoms (which may be substituted by a lower alkoxy group containing from 1 to 4 carbon atoms, a chlorine atom, a fluorine atom, or a phenyl group), preferably an alkyl group substituted by an alkoxy group;

$R_{17}$, $R_{18}$, $R_{22}$ and $R_{24}$ are each a sulfoalkyl group containing from 2 to 4 carbon atoms, a carboxyalkyl group containing from 2 to 5 carbon atoms, a hydroxyalkyl group containing from 2 to 6 carbon atoms, an unsubstituted carbamoylalkyl group containing from 2 to 5 carbon atoms, or a lower alkyl group containing 6 or less carbon atoms (which may be substituted by a fluorine atom, a chlorine atom, an alkoxy group containing from 1 to 4 caebon atoms, a phenyl group, or a sulfophenyl group);

$R_{19}$ and $R_{23}$ are each a hydrogen atom, a chlorine atom, a bromine atom, a lower alkyl group containing from 1 to 7 carbon atoms, a lower alkoxy group containing from 1 to 6 carbon atoms, a carboxyl group, a hydroxyl group, an alkoxycarbonyl group containing 2 to 5 carbon atoms in total, an acylamino group wherein the number of carbon atoms in the acyl moiety being from 2 to 5, or a phenyl group (which may be substituted by a chlorine, a bromine atom, an alkyl group containing 4 or less carbon atoms, or an alkoxy group containing 4 or less carbon atoms);

$R_{17}$, $R_{18}$, $R_{22}$ and $R_{24}$ may be the same or different;

$R_{15}$, $R_{16}$, $R_{20}$ and $R_{21}$ may be the same or different;

$X_7$, $X_8$, $X_9$ and $X_{10}$ may be the same or different, and are each a sulfur atom or a selenium atom; and $R_{17}$, $R_{18}$, $R_{22}$ and $R_{24}$ are each most preferably a methyl group, an ethyl group, or a sulfopropyl group.
Typical examples of the compounds represented by the general formulae (I) and (II) are shown below:
I-1
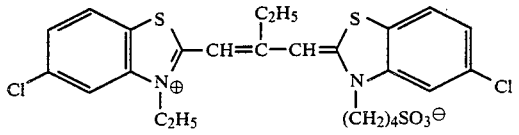
I-2
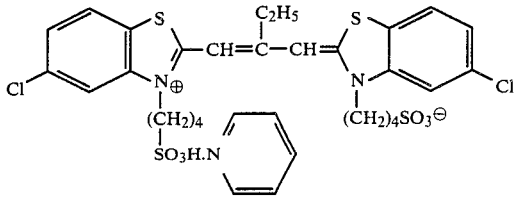
I-3
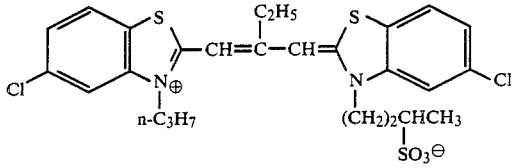
I-4
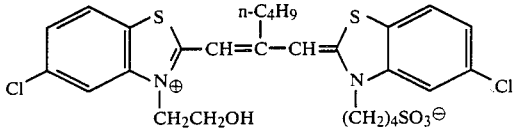
I-5
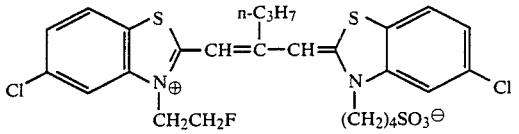
I-6
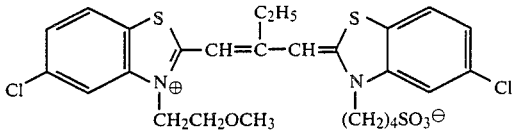
I-7
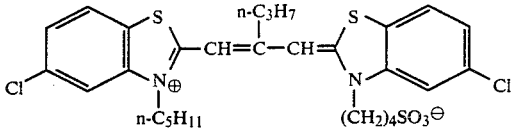
I-8
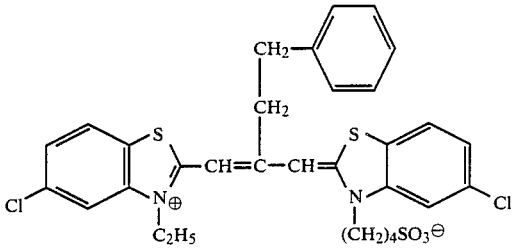
I-9
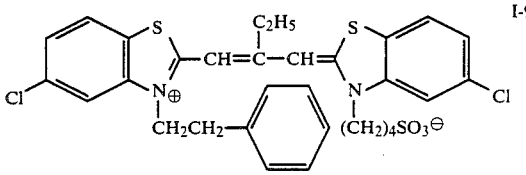
I-10
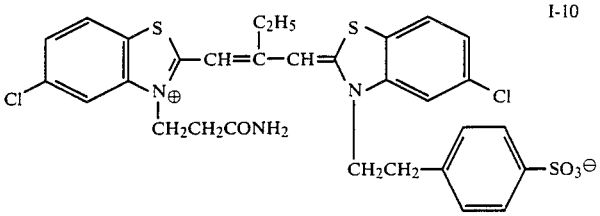
I-11
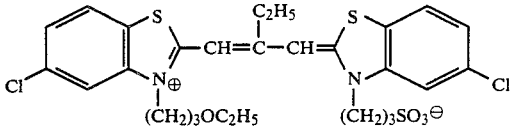
I-12
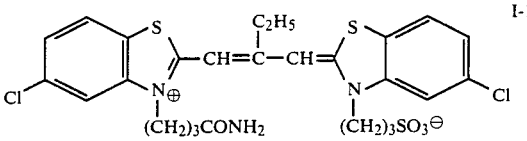
I-13
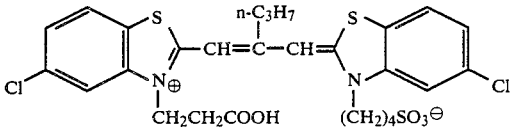
I-14
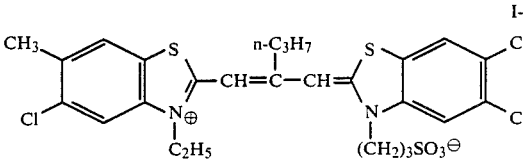
I-15
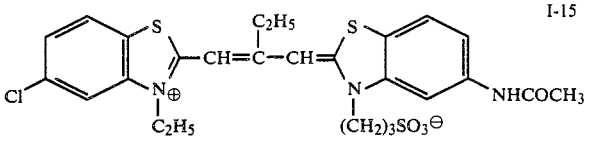
I-16
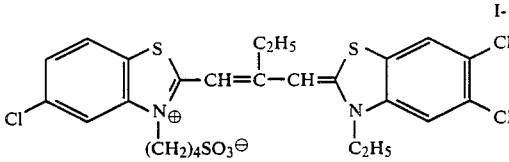

-continued
I-17
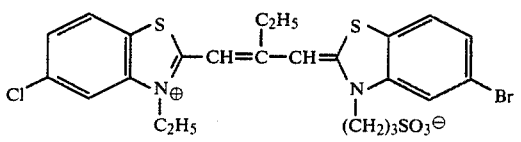
I-18
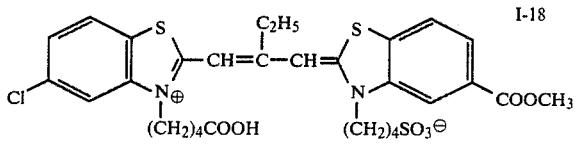
I-19
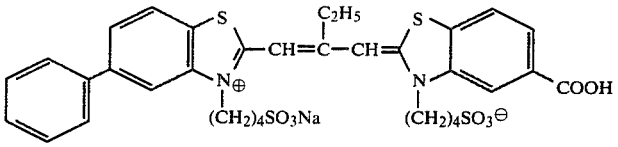
I-20
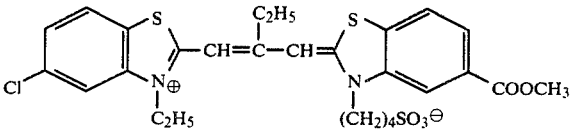
I-21
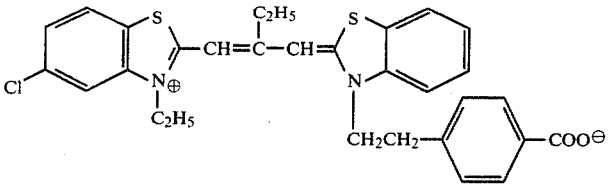
I-22
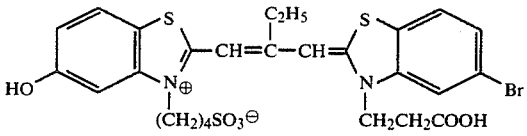
I-23
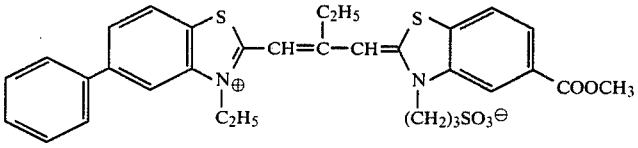
I-24
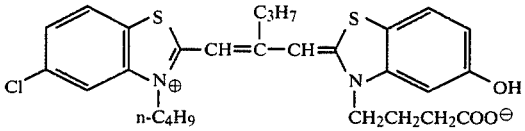
I-25
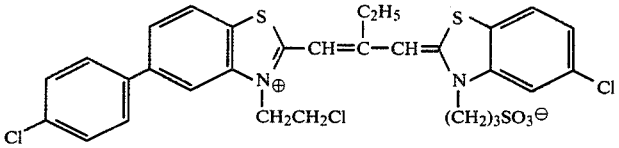
I-26
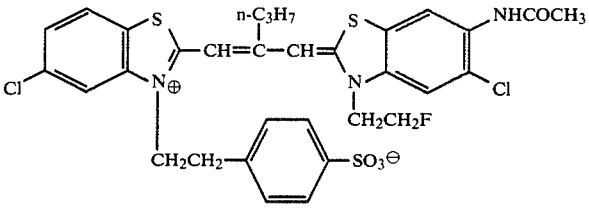

-continued
I-27
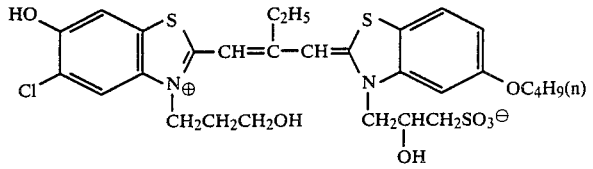
I-28
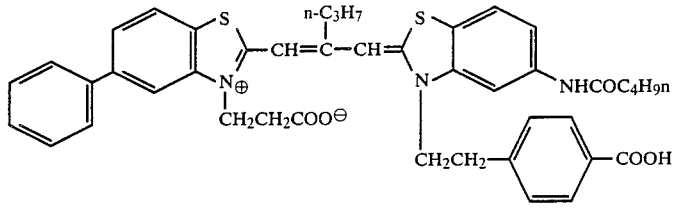
I-29
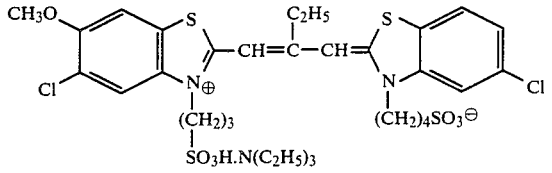
I-30
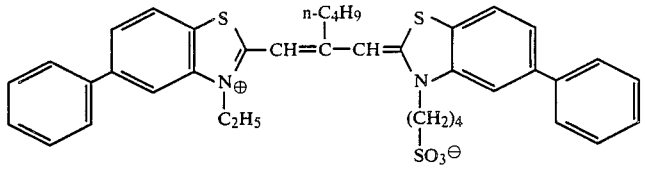
I-31
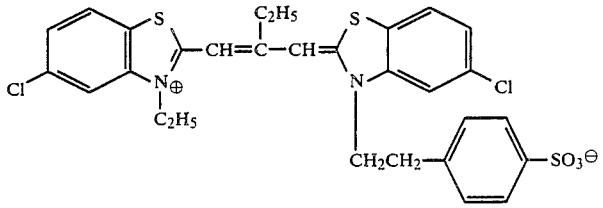
I-32
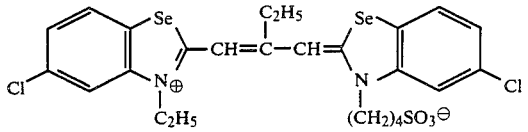
I-33
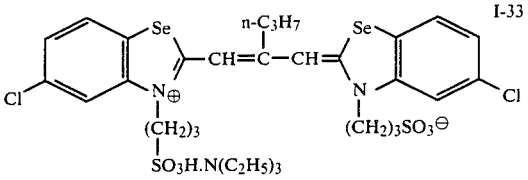
I-34
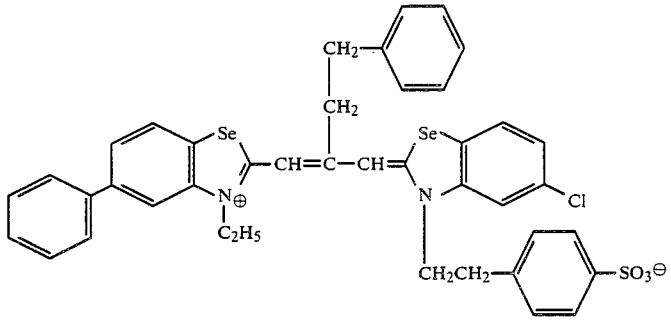

-continued
I-35
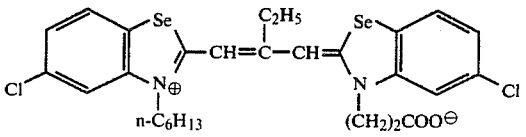
I-36
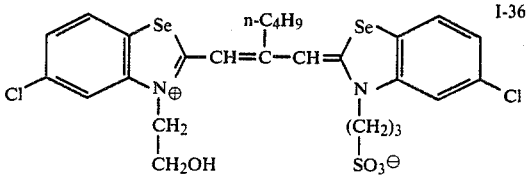
I-37
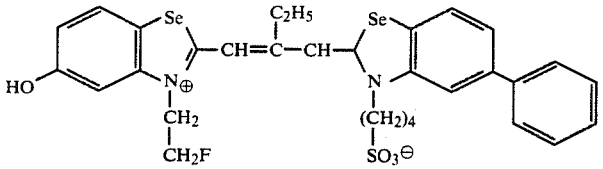
I-38
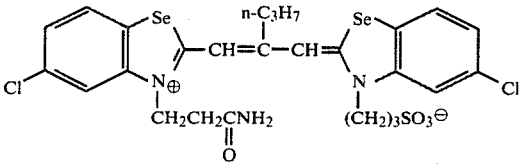
I-39
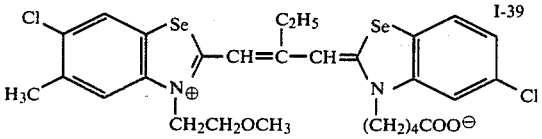
I-40
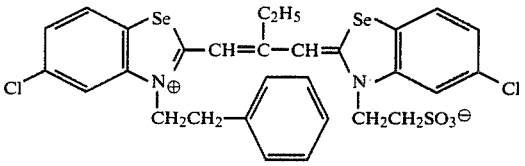
I-41
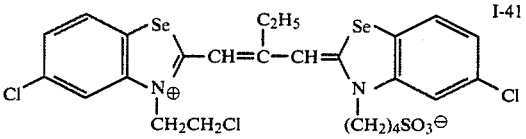
I-42
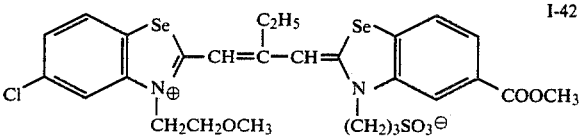
I-43
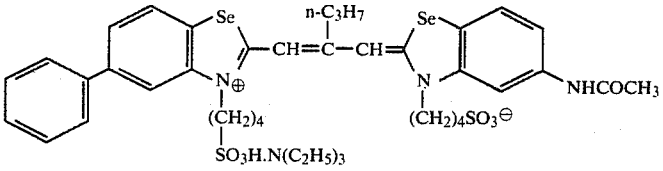
I-44
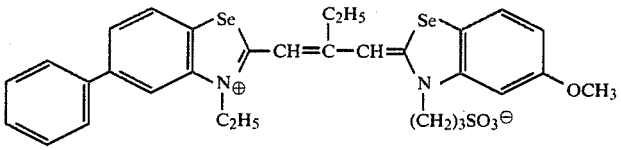
I-45
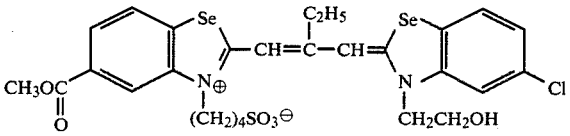
I-46
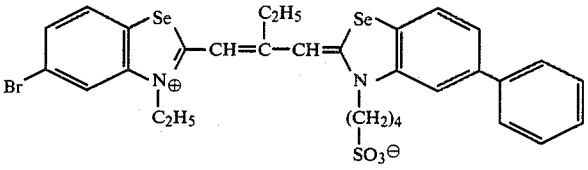

-continued
I-47
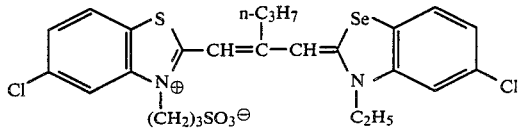
I-48
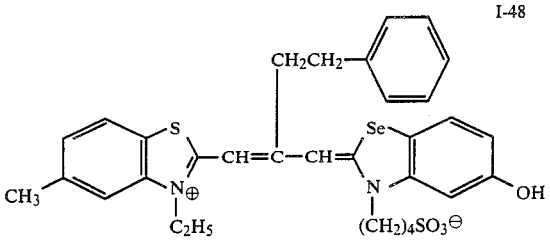
I-49
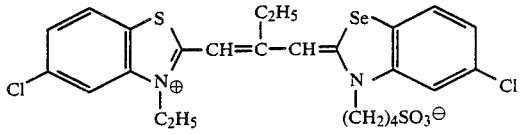
I-50
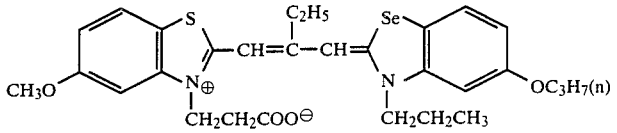
I-51
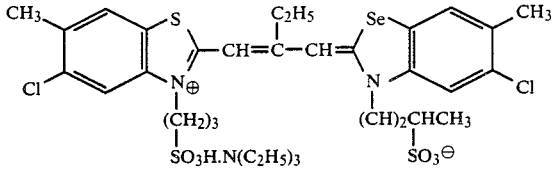
I-52
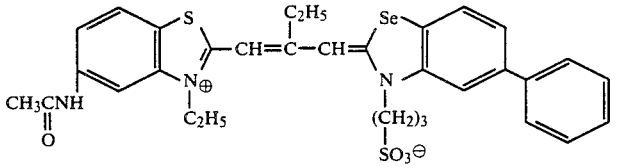
II-1
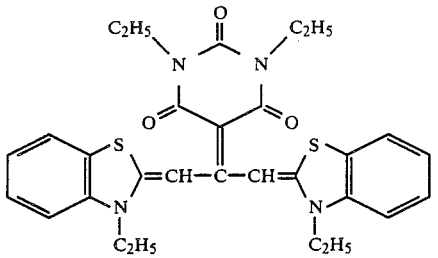
II-2
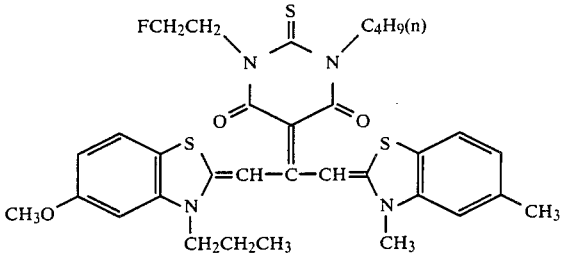
II-3
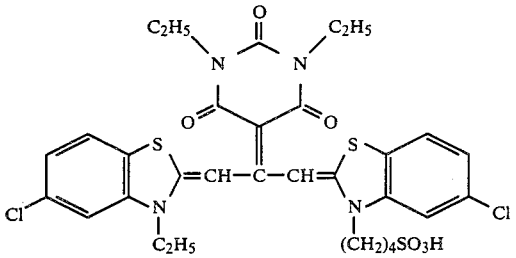
II-4
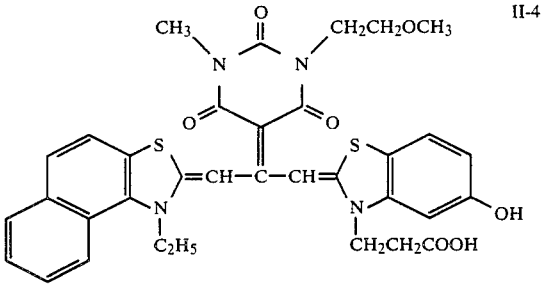

-continued
II-5
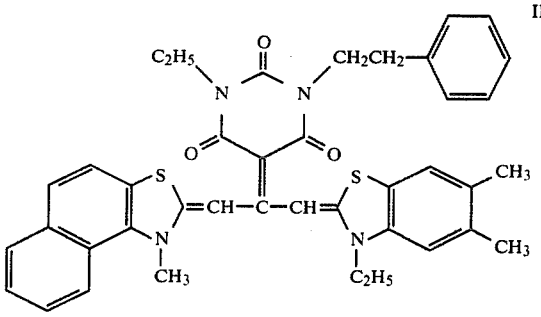
II-6
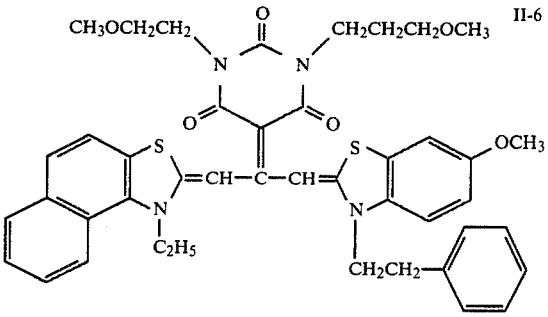
II-7
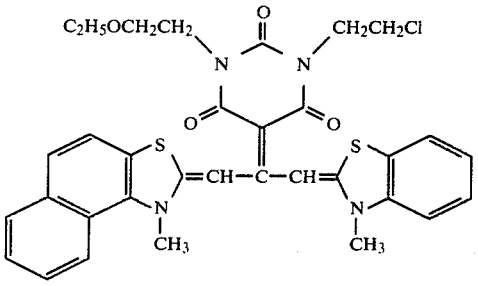
II-8
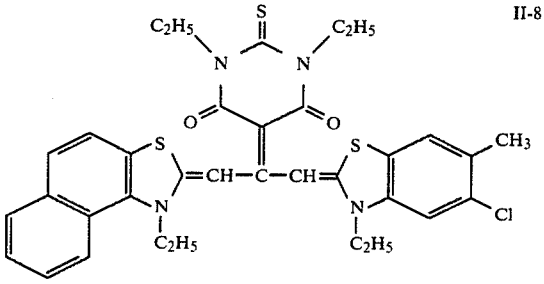
II-9
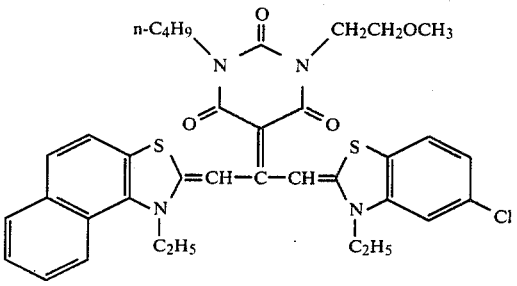
II-10
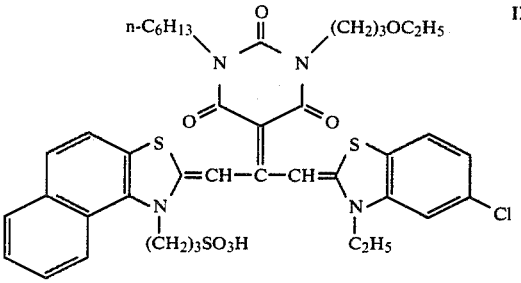
II-11
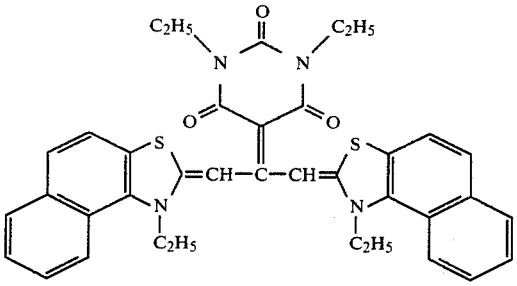
II-12
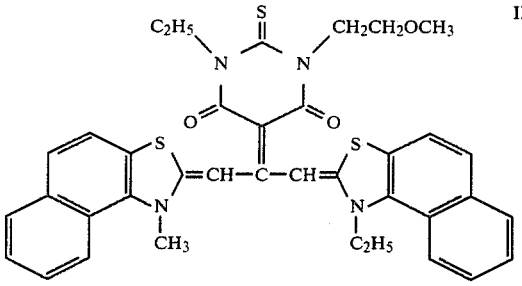
II-13
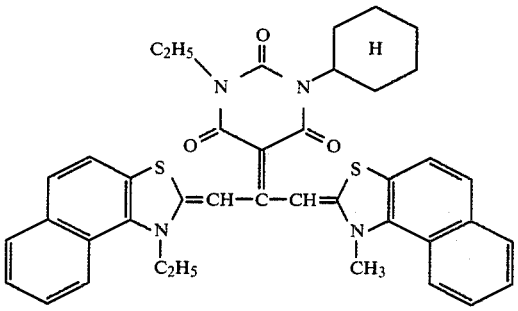
II-14
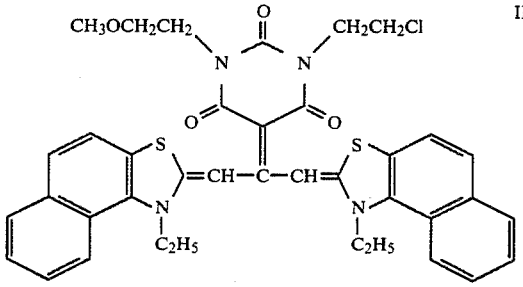

-continued
II-15
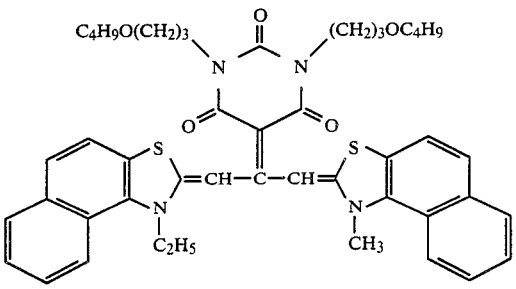
II-16
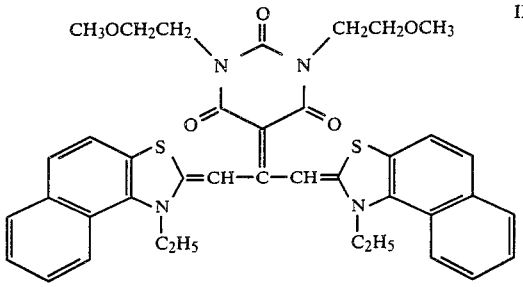
II-17
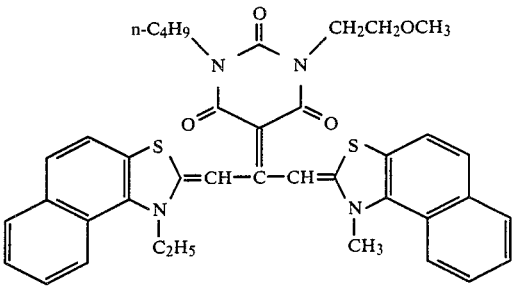
II-18
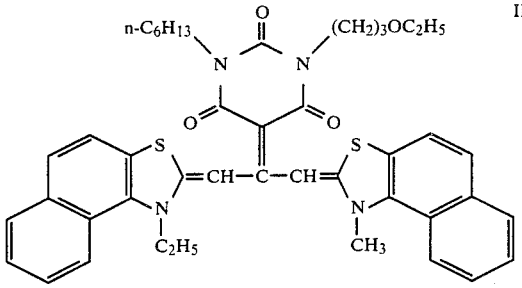
II-19
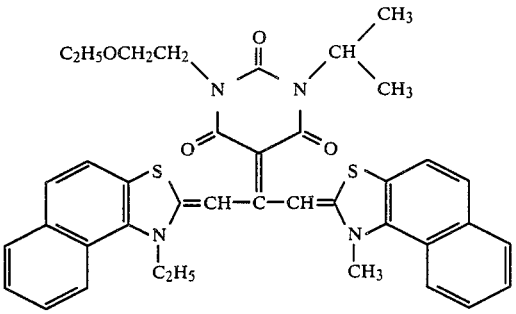
II-20
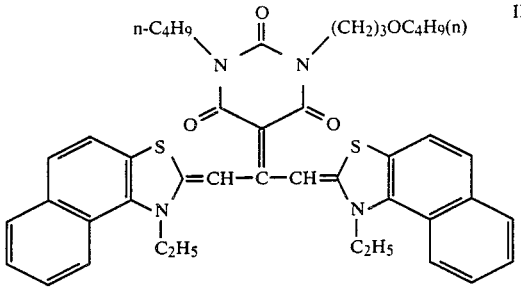
II-21
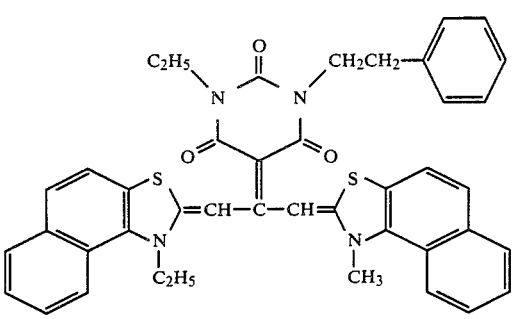
II-22
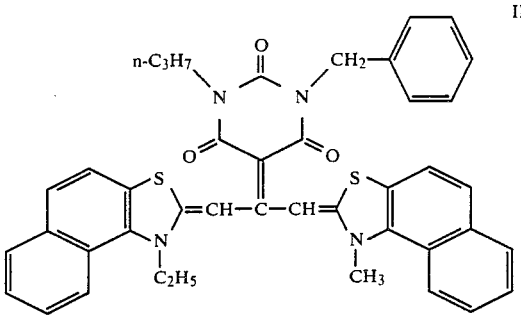
II-23
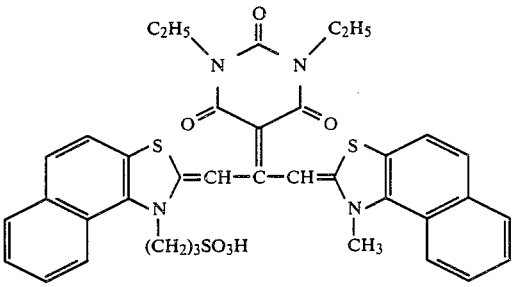
II-24
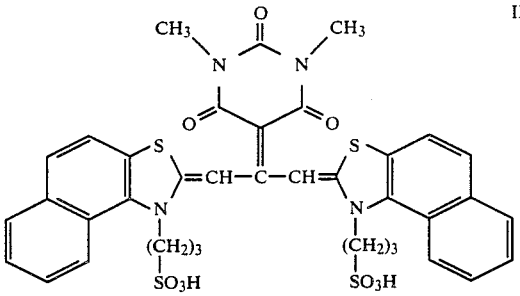

-continued

II-25

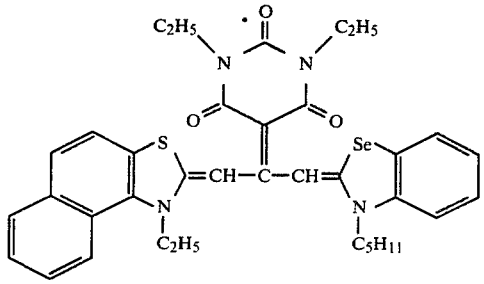

II-26

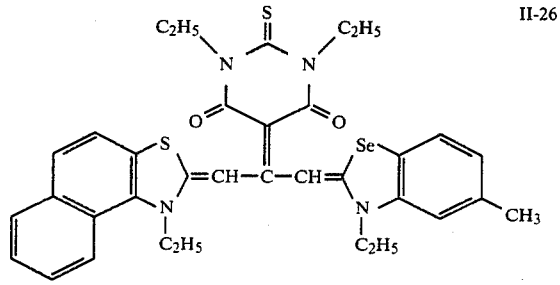

II-27

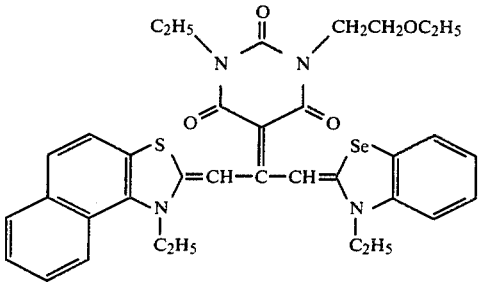

II-28

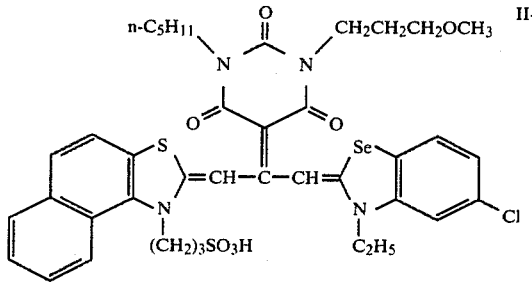

II-29

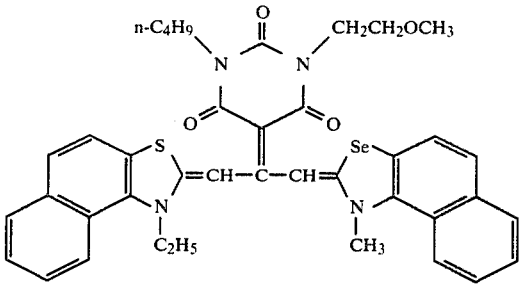

The compounds represented by the general formula (I) or (II) as used herein are known and are easily available. These compounds are described in, for example, U.S. Pat. Nos. 2,704,718 and 2,704,714 (incorporated herein by reference to disclose such compounds).

These compounds can be incorporated in photographic emulsions by the usual procedure. Usually they are dissolved in a solvent, e.g., methanol, ethanol, water, cellosolve, or water-soluble ketones, and then added to emulsions.

The amount of the compound represented by the general formula (I) being added is preferably from $10^{-6}$ to $10^{-3}$ mol per mol of silver halide used in a red-sensitive layer (i.e., total silver halide used in a red-sensitive emulsion layer including the surface low iodine type silver iodobromide and conventional silver iodobromide).

The molar ratio of the compound of the general formula (II) to the compound of the general formula (I) is preferably from 1:5 to 1:100 and more preferably from 1:10 to 1:50.

To photographic emulsions as used herein can be added various compounds known as antifoggants or stabilizers for the purpose of inhibiting fog during the process of production, storage or photographic processing of light-sensitive materials or of stabilizing their photographic performance. Such antifoggants or stabilizers include azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (in particular, 1-phenyl-5-mercaptotetrazole); mercaptopyrimidines; mercaptotriazines; thioketo compounds such as oxazolinethion; azaindenes such as triazaindenes, tetraazaindenes (in particular, 4-hydroxy-substituted(1,3-3a,7)tetraazaindenes), and pentaazaindenes; benzenethiosulfonic acid; benzenesulfinic acid; and benzenesulfonic acid amide. For example, those compounds as described in U.S. Pat. Nos. 3,954,474 and 3,982,947, and Japanese Patent Publication No. 28660/77 can be used.

For removal of soluble salts from silver halide emulsions after precipitate formation or physical ripening, there can be used the noodle washing method in which gelatin is gelatinized, and a flocculation method utilizing inorganic salts, anionic surface active agents, anionic polymers (e.g., polystyrenesulfonic acid), or gelatin derivatives (e.g., acylated gelatin and carbamoylated gelatin).

Silver halide emulsions are usually chemically sensitized. For this chemical sensitization, the methods described in, for example, H. Frieser ed., *Die Grundlagen der Photographischen Prozesse mit Silberhalogeniden*, pp. 675–734, Akademische Verlagsgesellschaft (1968) can be used.

A sulphur sensitization method using compounds containing sulfur capable of reacting with active gelatin or silver (such as thiosulfates, thioureas, mercapto compounds, and rhodanines), a reduction sensitization method using reducing substances (such as stannous salts, amines, hydrazine derivatives, formamidinesulfinic acid, and silane compounds), a noble metal sensitization method using noble metal compounds (such as gold complex salts, and complex salts of the metals of Group VIII of the Periodic Table (e.g., Pt, Ir and Pd)), and so forth can be used alone or in combination with each other.

The sulfur sensitization method is described in detail in U.S. Pat. Nos. 1,574,944, 2,410,689, 2,278,947, 2,728,668, 3,656,955, etc.; the reduction sensitization method, in U.S. Pat. Nos. 2,983,609, 2,419,974, 4,054,458, etc.; and the noble metal sensitization method, in U.S. Pat. Nos. 2,399,083, 2,448,060, British Pat. No. 618,061, etc.

As a binder or protective colloid for photographic emulsions, it is advantageous to use gelatin. Other hydrophilic colloids can be used. For example, gelatin derivatives, graft polymers of gelatin with other polymers; proteins such as albumin and casein; cellulose derivatives such as hydroxyethyl cellulose, carboxymethyl cellulose, and cellulose sulfuric acid esters; sugar derivatives such as sodium alginate and starch derivatives; and synthetic hydrophilic polymers, homopolymers or copolymers, such as polyvinyl alcohol, partially acetalated polyvinyl alcohol, poly-N-vinyl pyrrolidone, polyacrylic acid, polymethacrylic acid, polyacrylamide, polyvinyl imidazole, and polyvinyl pyrazole can be used.

Photographic emulsions as used herein may be spectrally sensitized in blue-sensitive and green-sensitive regions by the use of methine dyes, etc.

Useful sensitizing dyes are described in, for example, West German Pat. No. 929,080, U.S. Pat. Nos. 2,493,748, 2,503,776, 2,519,001, 2,912,329, 3,656,959, 3,672,897, 3,694,217, 4,025,349, 4,046,572, British Pat. No. 1,242,588, Japanese Patent Publication Nos. 14030/69 and 24844/77.

These sensitizing dyes may be used alone or in combination with each other. Combinations of sensitizing dyes are often used particularly for the purpose of supersensitization. Typical examples are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862, 4,026,707, British Pat. Nos. 1,344,281, 1,507,803, Japanese Patent Publication Nos. 4936/68, 12375/78, Japanese Patent Application (OPI) Nos. 110618/77 and 109925/77 (the term "OPI" as used herein refers to a "published unexamined Japanese patent application").

Dyes which themselves have no spectral sensitization effect, or substances which do not substantially absorb visible light, but exhibit supersensitization may be added to the emulsions in combination with sensitizing dyes. Examples are aminostilbene compounds substituted with a nitrogen-containing heterocyclic ring (as described in, for example, U.S. Pat. Nos. 2,933,390 and 3,635,721), aromatic organic acid-formaldehyde condensates (as described in, for example, U.S. Pat. No. 3,743,510), cadmium salts, and azaindene compounds. Combinations as described in U.S. Pat. Nos. 3,615,613, 3,615,641, 3,617,295, and 3,635,721 are particularly useful.

Color-forming couplers, i.e., compounds capable of forming color by oxidative coupling with aromatic primary amine developers (e.g., phenylenediamine derivatives and aminophenol derivatives), as used in the photographic emulsion layers of the photographic light-sensitive material of the invention include magenta couplers, such as a 5-pyrazolone coupler, a pyrazolobenzimidazole coupler, a cyanoacetylcumarone coupler, and an open-chain acylacetonitrile coupler; yellow couplers, such as an acylacetamide coupler (e.g., benzoylacetanilides and pivaroylacetanilides); and cyan couplers, such as a naphthol coupler and a phenol coupler. These couplers are desirable to be of the nondiffusion type that contains a hydrophobic group called a ballast group in the molecule. The couplers may be 4-equivalent or 2-equivalent in relation to silver ion. Furthermore, they may be colored couplers having a color-correction effect, or so-called DIR couplers capable of releasing a development inhibitor as the development proceeds.

In addition to the DIR couplers, colorless DIR coupling compounds which provide a colorless product upon coupling reaction and release a development inhibitor may be incorporated.

Incorporation of the couplers in a silver halide emulsion layer can be conducted by known techniques such as the method described in U.S. Pat. No. 2,322,027. For example, the couplers are dissolved in a high-boiling point organic solvent such as phthalic acid alkyl esters (e.g., dibutyl phthalate and dioctyl phthalate), phosphoric acid esters (e.g., diphenyl phosphate, triphenyl phosphate, tricresyl phosphate, and dioctylbutyl phosphate), citric acid esters (e.g., tributyl acetylcitrate), benzoic acid esters (e.g., octyl benzoate), alkylamides (e.g., diethyllaurylamide), fatty acid esters (e.g., dibutoxyethyl succinate and dioctyl azelate), trimesic acid esters (e.g., tributyl trimesicate), or the like, or a low-boiling point organic solvent having a boiling point of from about 30° to 150° C. (e.g., lower alkyl acetates such as ethyl acetate and butyl acetate, ethyl propionate, sec-butyl alcohol, methyl isobutyl ketone, $\beta$-ethoxyethyl, acetate, and methyl cellosolve) and, thereafter, dissolved in hydrophilic colloid. The foregoing high-boiling point and low-boiling point organic solvents may be used in combination with each other.

To the color light-sensitive material of the invention may further be added various known additives, such as dyes, hardeners, surface active agents, discoloration-inhibitors, development accelerators, UV absorbents, matting agents, and fluorescent whiteners.

These additives are described in detail in, for example, *Research Disclosure,* No. 176, RD-17643.

In preparing the color light-sensitive material of the invention, the photographic emulsion layers and other layers are coated on a conventional flexible support, such as a plastic film, paper, and cloth, or a rigid support, such as glass, porcelain, and metal. Useful examples of such flexible supports are films made of semi-synthetic or synthetic polymers, such as cellulose nitrate, cellulose acetate, cellulose acetate butyrate, polystyrene, polyvinyl chloride, polyethylene terephthalate, and polycarbonate, and paper which is coated or laminated with a baryta layer or an $\alpha$-olefin polymer (e.g., polyethylene, polypropylene, and an ethylene/butene copolymer). The support may be colored with dyes or pigments. For the purpose of shielding light, the support may be rendered black. In general, the surface of the support is subjected to a subbing treatment in order to improve adhesion with the photographic emulsion layers, etc. On the support surface may be applied, before or after the subbing treatment, to a corona discharging treatment, an ultraviolet ray irradiation treatment, a flame treatment, etc.

The silver halide color light-sensitive material of the invention can be used as a color film for photographing, such as a color negative film and a color reversal film, and furthermore, as a light-sensitive material for print, such as a color paper.

In photographic processing of the color light-sensitive material of the invention, the known methods and processing liquids described in, for example, *Research Disclosure,* No. 176, pp. 28–30 (RD-17643) can be used. The processing temperature is usually chosen within the range of from 18° to 50° C., although the processing may be carried out at temperatures lower than 18° C. or higher than 50° C.

Dye images can be formed in the usual manner. For example, a negative-positive process (which is described in, for example, *Journal of the Society of Motion Picture and Television Engineers,* pp. 667–701, Vol. 61 (1953)); a color reversal process in which development is conducted using a developer containing a black-and-white developing agent to form a negative silver image, at least one uniform exposure or other suitable fogging treatments are applied, and subsequently, color development is conducted to obtain a positive dye image; and a silver dye-bleaching process in which a photographic emulsion layer containing dye is exposed to light and developed to form a silver image and, with the thus-formed silver image as a bleaching catalyst, dye is bleached, can be used.

Color developers generally comprises alkaline aqueous solutions containing color developing agents. Examples of the color developing agents include the known primary aromatic amines, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, and 4-amino-3-methyl-N-ethyl-N-β-methoxyethylaniline).

In addition, those developing agents as described in L. F. A. Mason, *Photographic Processing Chemistry,* pp. 226–229, Focal Press Co. (1966), U.S. Pat. Nos. 2,193,015, 2,592,364, Japanese Patent Application (OPI) No. 64933/73, etc., may be used.

The color developers can further contain pH buffers, development inhibitors or antifoggants, etc. If desired, hard water-softening agents, preservatives, organic solvents, development accelerators, dye-forming couplers, competitive couplers, foggants, auxiliary developers, viscosity imparting agents, polycarboxylic acid-based chelating agents, antioxidants, etc., may be incorporated.

Specific examples of such additives are described in, for example, *Research Disclosure* (RD-17643), U.S. Pat. No. 4,083,723, and West German Patent Application (OLS) No. 2,622,950.

After the color development, the photographic emulsion layers are usually bleached. This bleach processing may be performed simultaneously with a fixing processing, or they may be carried out separately. Bleaching agents which can be used include compounds of multivalent metals such as iron (III), cobalt (III), chromium (VI), and copper (II), peracids, quinones, and nitroso compounds.

To such bleaching or bleach-fixing solutions may be added various additives such as bleach accelerators as described in, for example, U.S. Pat. Nos. 3,042,520, 3,241,966, Japanese Patent Publication Nos. 8506/70 and 8836/70, and thiol compounds as described in Japanese Patent Application (OPI) No. 65732/78.

The present invention is explained in greater detail by reference to the following examples. However, the scope of the invention is not limited to these examples.

EXAMPLE 1

A double jet type silver iodobromide emulsion containing 4.0 mol% of iodide ion was prepared as follows:

A mixture of 1,000 ml of water, 25 g of inactive gelatin, 4 g of potassium iodide, and 10 g of potassium bromide was placed in a reactor maintained at 60° C. and continuously stirred.

A solution of 100 g of silver nitrate dissolved in 300 ml of water and a solution of 85 g of potassium bromide dissolved in 250 g of water were each added to the reactor continuously over a period of 36 minutes. Subsequently, the resulting emulsion was solidified by cooling to form a noddle-like material and water-soluble materials were removed from the noddle-like material by water washing.

A 1 mol solution of potassium bromide was then added to adjust to pAg=9.0, and the temperature of the reactor was maintained at 60° C. Under these conditions, a 0.01 mol solution of sodium dithiosulfite aurate (I) was added to the emulsion in an amount of 9 ml per 1 kg of the emulsion, and the resulting mixture was aged for 30 minutes.

To the thus-produced silver iodobromide emulsion having a mean grain size of 0.6μ were added potassium iodide and red-sensitizing dye in this order in the amounts shown in Table 1 to allow them to be adsorbed on the grains.

The emulsion was then coated on a cellulose triacetate film in a silver coverage of 20 mg/dm$^2$ and a dry thickness of 2.5μ, and dried.

The thus-produced light-sensitive material was exposed to light through a yellow filter which inhibits the passage of blue light therethrough, making it possible to measure only the sensitivity in a spectral sensitization region, and a sensitometric wedge of neutral gray.

After exposure processing, the material was subjected to only the first development of reversal processing, water washing, fixation, water washing, and drying, as described hereinafter.

For each sample, the optical density of the silver image was measured. The sensitivity was presented as a logarithm of a reciprocal of an exposure amount necessary for attaining an effective density of 0.2 excluding fog. The results are shown in Table 2.

| Processing Steps | Time (minutes) | Temperature (°C.) |
|---|---|---|
| First Development | 6 | 38 |
| Water Washing | 2 | " |
| Fixation | 4 | " |
| Water Washing | 4 | " |
| Drying | 4 | " |

| First Developer | |
|---|---|
| Water | 700 ml |
| Sodium tetrapolyphosphate | 2 g |
| Sodium sulfite | 20 g |
| Hydroquinone monosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1,000 ml |
| **Fixer** | |
| Water | 800 ml |

-continued

| | |
|---|---|
| Ammonium thiosulfate | 80.0 g |
| Sodium sulfite | 5.0 g |
| Sodium hydrogensulfite | 5.0 g |
| Water to make | 1,000 ml |

TABLE 1

| | Sample Nos. | | | | | | | | | | |
|---|---|---|---|---|---|---|---|---|---|---|---|
| | A | B | C | D | E | F | G | H | I | J | K |
| Potassium Iodide (mg) | — | — | — | 30 | 60 | 120 | — | — | — | — | 60 |
| Dye No. I-1 (mg) | 120 | 180 | 240 | 180 | 180 | 180 | — | — | — | 180 | 180 |
| Dye No. II-3 (mg) | — | — | — | — | — | — | 4 | 8 | 12 | 12 | 12 |

Note: All amounts above are mg per mol of silver.

TABLE 2

| | Sample Nos. | | | | | | | | | | |
|---|---|---|---|---|---|---|---|---|---|---|---|
| | A | B | C | D | E | F | G | H | I | J | K |
| Sensitivity | 100 | 115 | 120 | 125 | 140 | 145 | 25 | 25 | 25 | 200 | 340 |

Note: Sensitivities expressed above are relative values with the sensitivity of Sample No. A being as 100.

Even if the amount of potassium iodide being added is increased, the sensitivity does not rise any more; rather development is retarded.

Table 2 clearly shows that if potassium iodide is used in combination within a range of amount of addition in which no significant increase in sensitivity is expected even if the amount of Dye No. I-1 being added is increased, a further increase in sensitivity is observed, but it is insufficient. However, in the system of Dye Nos. I-1 and II-3, when potassium iodide, in particular, is added, sensitization is efficiently achieved.

EXAMPLE 2

In this example, the present invention is applied as a red-sensitive layer of a color light-sensitive material.

A high sensitivity red-sensitive emulsion layer was prepared using the same silver iodobromide emulsion as used in Example 1, and a low sensitivity red-sensitive layer was prepared using a silver iodobromide emulsion having an iodine content of 4.0 mol% and a grain size of 0.35μ which had been prepared in the same manner as in Example 1. To each layer were added potassium iodide and red color-sensitizing dyes in this order in the amounts shown in Table 3. Samples 1 to 38 were produced as follows:

On a triacetyl cellulose support which had been provided with a subbing layer were coated the following emulsion layers and auxiliary layers.

First Layer: Low Sensitivity Red-Sensitive Emulsion Layer

A cyan coupler, 2-(heptafluorobutyramido)-5-[2'-(2'',4''-di-tert-aminophenoxy)butyramido]phenol (100 g), was dissolved in 100 ml of tricresyl phosphate and 100 ml of ethyl acetate and stirred at a high speed together with 1 kg of a 10% aqueous gelatin solution to obtain an emulsion. Then, 500 g of the above-prepared emulsion was mixed with 1 kg of the above-described low-sensitive red-sensitive silver iodobromide emulsion (70 g of silver, containing 60 g of gelatin, and having an iodine content of 4.0 mol%), and the resulting mixture was then coated in a dry thickness of 2μ (silver amount: 0.5 g/m$^2$).

Second Layer: High Sensitivity Red-Sensitive Emulsion Layer

A cyan coupler, 2-(heptafluorobutyramido)-5-[2'-(2'',4''-di-tert-aminophenoxy)butyramido]phenol (100 g), was dissolved in 100 ml of tricresyl phosphate and 100 ml of ethyl acetate and stirred at a high speed together with 1 kg of a 10% aqueous gelatin solution to obtain an emulsion. Then, 1,000 g of the above-prepared emulsion was mixed with 1 kg of the above-described high-sensitive red-sensitive silver iodobromide emulsion (silver: 70 g; gelatin content: 60 g; iodine content: 4.0 mol%). The resulting mixture was then coated in a dry thickness of 2μ (silver amount: 0.8 g/m$^2$).

Third Layer: Intermediate Layer 2,5-Di-tert-octylhydroquinone was dissolved in 100 ml of dibutyl phthalate and 100 ml of ethyl acetate, and stirred at a high speed together with 1 kg of a 10% aqueous gelatin solution to prepare an emulsion. Then, 1 kg of the above-prepared emulsion was mixed with 1 kg of a 10% aqueous gelatin solution, and the resulting mixture was coated in a dry thickness of 1μ.

Fourth Layer: Low Sensitivity Green-Sensitive Emulsion Layer

An emulsion was prepared in the same manner as in the preparation of the emulsion for the first layer except that a magenta coupler, 1-(2,4,6-trichlorophenyl)-3-[3-(2,4-di-tert-amylphenoxyacetamido)benzamido]-5-pyrazolone, was used in place of the cyan coupler. Then, 500 g of the thus-prepared emulsion was mixed with 1 kg of a green-sensitive, low-sensitive silver iodobromide emulsion (silver: 70 g; gelatin content: 60 g; iodine content: 2.5 mol%), and the resulting mixture was coated in a dry thickness of 2.0μ (silver amount: 0.7 g/m$^2$).

Fifth Layer: High Sensitivity Green-Sensitive Emulsion Layer

An emulsion was prepared in the same manner as in the preparation of the emulsion for the first layer except that a magenta coupler, 1-(2,4,6-trichlorophenyl)-3-[3-(2,4-di-tert-amylphenoxyacetamido)benzamido[-5-pyrazolone, was used in place of the cyan coupler. Then, 1,000 g of the thus-prepared emulsion was mixed with 1 kg of a green-sensitive, high-sensitive silver iodobromide emulsion (silver: 70 g; gelatin content: 60 g; iodine content: 2.5 mol%), and the resulting mixture was coated in a dry thickness of 2.0μ (silver amount: 0.7 g/m$^2$).

Sixth Layer: Intermediate Layer

The emulsion (1 kg) used in the preparation of the third layer was mixed with 1 kg of a 10% aqueous gelatin solution and coated in a dry thickness of 1μ.

Seventh Layer: Yellow Filter Layer

An emulsion containing yellow colloidal silver was coated in a dry thickness of 1μ.

Eighth Layer: Low Sensitivity Blue-Sensitive Emulsion Layer

An emulsion was prepared in the same manner as in the preparation of the emulsion for the first layer except that a yellow coupler, α-(pivaloyl)-α-(1-benzyl-5-ethoxy-3-hydantoinyl)-2-chloro-5-dodecyloxycarbonylacetanilide, was used in place of the cyan coupler. Then, 1,000 g of the thus-prepared emulsion was mixed with 1 kg of a blue-sensitive, high-sensitive silver iodobromide emulsion (silver: 70 g; gelatin content: 60 g; iodine content: 2.5 mol%), and the resulting mixture was coated in a dry thickness of 2.0μ (silver amount: 0.6 g/m$^2$).

Ninth Layer: High Sensitivity Blue-Sensitive Emulsion Layer

An emulsion was prepared in the same manner as in the preparation of the emulsion for the first layer except that a yellow coupler, α-(pivaloyl)-α-(1-benzyl-5-ethoxy-3-hydantoinyl-2-chloro-5-dodecyloxycarbonylacetanilide, was used in place of the cyan coupler. Then, 1,000 g of the thus-prepared emulsion was mixed with 1 kg of a blue-sensitive, high-sensitive silver iodobromide emulsion (silver: 70 g, gelatin content: 60 g; iodine content: 2.5 mol%), and the resulting mixture was coated in a dry thickness of 2.0μ (silver amount: 1.0 g/m$^2$).

Tenth Layer: Second Protective Layer

The emulsion (1 kg) as used in the preparation of the third layer was mixed with 1 kg of a 10% aqueous gelatin solution and coated in a dry thickness of 2μ.

Eleventh Layer: First Protective Layer

A 10% aqueous gelatin solution containing a fine silver iodobromide grain emulsion which had not been chemically sensitized (grain size: 0.15μ; 1 mol% silver iodobromide emulsion) was coated so that the amount of silver coated was 0.3 g/m$^2$ and the dry thickness was 1μ.

The thus-produced film was exposed to white light through a sensitometric wedge by the use of a 4,800° K. light source in such a manner that the illuminance of the exposed surface was 50 lux and, thereafter, a reversal processing as described hereinafter was applied to obtain a color image. The optical density of the cyan image was measured through a red filter, and the sensitivity was presented as a logarithm of a reciprocal of an exposure amount necessary to attain an effective density of 1.0 excluding fog.

The results are shown in Table 3.

TABLE 3

| Sample No. | Compound Added (amount) (mg) | | Amount of Potassium Iodide (mg) | Sensitivity |
|---|---|---|---|---|
| 1 | I-1 (180) | II-3 (12) | — | 100 |
| 2 | " | " | 60 | 160 |
| 3 | I-3 (180) | II-3 (12) | — | 90 |
| 4 | " | " | 60 | 140 |
| 5 | I-9 (180) | II-3 (12) | — | 85 |
| 6 | " | " | 60 | 130 |
| 7 | I-14 (180) | II-3 (12) | — | 60 |
| 8 | " | " | 60 | 95 |

TABLE 3-continued

| Sample No. | Compound Added (amount) (mg) | | Amount of Potassium Iodide (mg) | Sensitivity |
|---|---|---|---|---|
| 9 | I-25 (180) | II-3 (12) | — | 75 |
| 10 | " | " | 60 | 120 |
| 11 | I-9 (180) | II-9 (12) | — | 80 |
| 12 | " | " | 60 | 125 |
| 13 | I-1 (180) | II-15 (12) | — | 85 |
| 14 | " | " | 60 | 140 |
| 15 | I-1 (180) | II-17 (12) | — | 95 |
| 16 | " | " | 60 | 155 |
| 17 | I-1 (180) | II-23 (12) | — | 60 |
| 18 | " | " | 60 | 100 |
| 19 | I-8 (180) | II-3 (12) | — | 80 |
| 20 | " | " | 60 | 125 |
| 21 | I-21 (180) | II-8 (12) | — | 65 |
| 22 | " | " | 60 | 110 |
| 23 | I-25 (180) | II-11 (12) | — | 85 |
| 24 | " | " | 60 | 140 |
| 25 | I-31 (180) | II-18 (12) | — | 75 |
| 26 | " | " | 60 | 135 |
| 27 | I-33 (180) | II-3 (12) | — | 85 |
| 28 | " | " | 60 | 130 |
| 29 | I-32 (180) | II-29 (12) | — | 190 |
| 30 | " | " | 60 | 150 |
| 31 | I-49 (180) | II-6 (12) | — | 60 |
| 32 | " | " | 60 | 115 |
| 33 | I-1 (180) | I-23 (60) | — | 80 |
| 34 | " | " | 60 | 85 |
| 35 | I-1 (180) | I-25 (60) | — | 75 |
| 36 | " | " | 60 | 80 |
| 37 | I-1 (180) | I-30 (60) | — | 85 |
| 38 | " | " | 60 | 85 |

Note: The sensitivity is shown as a relative sensitivity with the sensitivity of Sample No. 1 being as 100. The amount added is per mol of silver.

As can be seen from the results of Table 3, the addition of each of the compounds represented by the general formulae (I) and (II) plus potassium iodide results in a great increase in sensitivity (Samples with even numbers (2 to 32)).

On the other hand, when only thiacarbocyanine and potassium iodide were added (Sample Nos. 34, 36 and 38), almost no increase in sensitivity was observed.

| Processing Steps | Time (minutes) | Temperature (°C.) |
|---|---|---|
| First Development | 6 | 38 |
| Water Washing | 2 | " |
| Reversal | 2 | " |
| Color Development | 6 | " |
| Conditioning | 2 | " |
| Bleach | 6 | " |
| Fixation | 4 | " |
| Water Washing | 4 | " |
| Stabilization | 1 | Ordinary temperature |
| Drying | | |

| | |
|---|---|
| First Developing Bath | |
| Water | 700 ml |
| Sodium tetrapolyphosphate | 2 g |
| Sodium sulfite | 20 g |
| Hydroquinone monosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1,000 ml |
| Reversal Bath | |
| Water | 700 ml |
| Nitrilo-N,N,N—trimethylenephosphonic acid hexasodium salt | 3 g |
| Stannous chloride (dihydrate) | 1 g |

-continued

| | |
|---|---|
| p-Aminophenol | 0.1 g |
| Sodium hydroxide | 8 g |
| Glacial acetic acid | 15 ml |
| Water to make | 1,000 ml |
| Color Developing Bath | |
| Water | 700 ml |
| Sodium tetrapolyphosphate | 2 g |
| Sodium sulfite | 7 g |
| Sodium tertiary phosphate (12 hydrate) | 36 g |
| Potassium bromide | 1 g |
| Potassium iodide (0.1% solution) | 90 ml |
| Sodium hydroxide | 3 g |
| Citrazinic acid | 1.5 g |
| N—Ethyl-N—(β-methanesulfonamidoethyl)-3-methyl-4-aminoaniline sulfate | 11 g |
| Ethylenediamine | 3 g |
| Water to make | 1,000 ml |
| Conditioner Bath | |
| Water | 700 ml |
| Sodium sulfite | 12 g |
| Sodium ethylenediaminetetraacetate (dihydrate) | 8 g |
| Thioglycerine | 0.4 ml |
| Glacial acetic acid | 3 ml |
| Water to make | 1,000 ml |
| Bleaching Bath | |
| Water | 800 ml |
| Sodium ethylenediaminetetraacetate (dihydrate) | 2.0 g |
| Iron (II) ammonium ethylenediamine-tetraacetate (dihydrate) | 120.0 g |
| Potassium bromide | 100.0 g |
| Water to make | 1,000 ml |
| Fixing Bath | |
| Water | 800 ml |
| Ammonium thiosulfate | 80.0 g |
| Sodium sulfite | 5.0 g |
| Sodium hydrogensulfite | 5.0 g |
| Water to make | 1,000 ml |
| Stabilizing Bath | |
| Water | 800 ml |
| Formalin (37% by weight) | 5.0 ml |
| Fuji Driwel | 5.0 ml |
| Water to make | 1,000 ml |

EXAMPLE 3

Sample Nos. 15, 16, 29, 30, 31 and 32 as obtained in Example 2 were each wedge-exposed to red light or green light and, thereafter, developed in the same manner as in Example 2. With the thus-processed samples, the density of magenta or cyan was measured to determine their characteristic curves.

Based on the characteristic curve, a difference in exposure amount (sensitivity) required to obtain magenta and cyan of predetermined densities (D=1.00 and D=2.00) was calculated to evaluate the color reproducibility of red light and green light. The results are shown in Tables 4 and 5.

TABLE 4

| Sample No. | $D_{max}$ Magenta | $D_{max}$ Cyan | Sensitivity of Green-Sensitive Layer* (D = 2.00) |
|---|---|---|---|
| 15 | 3.20 | 3.16 | −3.24 |
| 16 | 3.20 | 3.19 | lower than −4 |
| 29 | 3.19 | 3.14 | −3.15 |
| 30 | 3.20 | 3.16 | lower than −4 |
| 31 | 3.19 | 3.14 | −3.20 |
| 32 | 3.19 | 3.15 | lower than −4 |

Note: *The sensitivity of the green-sensitive layer (cyan color-forming layer) is indicated with that of the red-sensitive layer (magenta color-forming layer) being as 0.

As can be seen from the results of Table 4, the addition of iodide ion results in a reduction (at least about 0.8 as expressed in log E) in the sensitivity of the green-sensitive layer to red light. Thus, it becomes possible to completely avoid color-mixing of green color with red color, and the reproducibility of red color is greatly improved.

TABLE 5

| Sample No. | $D_{max}$ Magenta | $D_{max}$ Cyan | Sensitivity of Red-Sensitive Layer* D = 1.00 | Sensitivity of Red-Sensitive Layer* D = 2.00 |
|---|---|---|---|---|
| 15 | 3.21 | 3.17 | −0.95 | −1.00 |
| 16 | 3.21 | 3.20 | −1.13 | −1.25 |
| 29 | 3.22 | 3.15 | −0.92 | −0.99 |
| 30 | 3.21 | 3.18 | −1.07 | −1.21 |
| 31 | 3.22 | 3.15 | −0.93 | −0.97 |
| 32 | 3.21 | 3.17 | −1.08 | −1.19 |

Note: *The sensitivity of the red-sensitive layer is indicated with the sensitivity of the green-sensitive layer being as 0.

As can be seen from the results of Table 5, the addition of iodide ion results in a reduction (about 0.20 as expressed in log E) in the sensitivity of the red-sensitive layer to green light. Thus, it becomes possible to greatly reduce the color mixing of red color with green color, and the reproducibility of green color is greatly improved.

While the invention has been described in detail and with reference to specific embodiments thereof, it will be apparent to one skilled in the art that various changes and modifications can be made therein without departing from the spirit and scope thereof.

What is claimed is:

1. A process for producing a silver halide color photographic light-sensitive material comprising:

providing a silver halide emulsion layer, adding iodide ion to a surface low iodine content type silver iodobromide emulsion to adsorb the iodide ion on the surface of the silver iodobromide grains in an amount from $10^{-7}$ to $10^{-3}$ mol of the iodide ion per mol of the silver iodobromide; and adding at least one compound represented by the general formula (I) and at least one compound represented by the general formula (II) to the silver iodobromide emulsion:

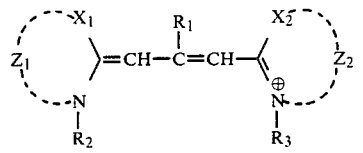

(I)

wherein $X_1$ and $X_2$ are each a sulfur atom or a selenium atom, $Z_1$ and $Z_2$ are each atoms necessary for forming, a benzothiazole, a benzoselenazole, a naphthothiazole or a naphthoselenazole, together with the nitrogen atom and $X_1$ or $X_2$, $R_1$ is a hydrogen atom, an alkyl group containing 6 or less carbon atoms, an aralkyl group containing 12 or less carbon atoms, or a phenyl group, and $R_2$ and $R_3$ are each an alkyl group containing 10 or less carbon atoms, or an alkyl group containing 10 or less carbon atoms which is substituted by a sulfo group, a hydroxyl group, a carboxyl group, a carbamoyl group, an alkoxy group, a phenyl group, a sulfophenyl group, a carboxyphenyl group, or a halogen atom, and at least one of $R_2$ and $R_3$ contains a sulfo group or a carboxyl group, and at least one compound represented by the general formula (II):

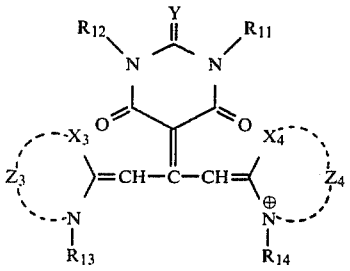

(II)

wherein Y is an oxygen atom or a sulfur atom, $X_3$ and $X_4$ are each a sulfur atom or a selenium atom, $Z_3$ and $Z_4$ are each atoms necessary for forming a benzothiazole, a benzoselenazole, a naphthothiazole or a naphthoselenazole, together with the nitrogen atom and $X_3$ or $X_4$, $R_{11}$ and $R_{12}$ are each an alkyl group containing 6 or less carbon atoms, or an alkyl group containing 6 or less carbon atoms which is substituted by an alkoxyl group containing from 1 to 4 carbon atoms, a chlorine atom, a fluorine atom, or a phenyl group, and $R_{13}$ and $R_{14}$ are each an alkyl group containing 10 or less carbon atoms, or an alkyl group containing 6 or less carbon atoms which is substituted by a sulfo group, a hydroxyl group, a carboxyl group, a carbamoyl group, an alkoxy group, a phenyl group, a sulfophenyl group, a carboxyphenyl group, or a halogen atom.

2. A process for producing a silver halide color light-sensitive material as claimed in claim 1, wherein the surface low iodine content type silver iodobromide photographic emulsion has an iodine content as a whole of grains in the range of 1 to 10 mol% as determined by X-ray analysis.

3. A process for producing a silver halide color light-sensitive material as claimed in claim 1, wherein the surface low iodine content type silver iodobromide photographic emulsion contains surface iodine in an amount of 0.5 to 8 mol% as determined by an X-ray photoelectronic spectrometry process.

4. A process for producing a silver halide color light-sensitive material as claimed in claim 1, wherein the surface low iodine content type silver iodobromide photographic emulsion has an iodine content as a whole of grains in the range of 1.5 to 5 mol% as determined by X-ray analysis.

5. A process for producing a silver halide color light-sensitive material as claimed in claim 4, wherein the surface iodine content as determined by an X-ray photoelectronic spectrometry process is in the range of 1 to 3.5 mol%.

6. A process for producing a silver halide color light-sensitive material as claimed in claim 1, wherein the silver halide emulsion layer includes a red-sensitive layer which includes surface low iodine type silver iodobromide in a proportion of 50 wt% or more.

7. A process for producing a silver halide color light-sensitive material as claimed in claim 6, wherein the surface low iodine type silver iodobromide is present in an amount of 60 wt% or more.

8. A process for producing a silver halide color light-sensitive material as claimed in claim 1, wherein the compound represented by the general formula (I) is a compound represented by the general formula (III):

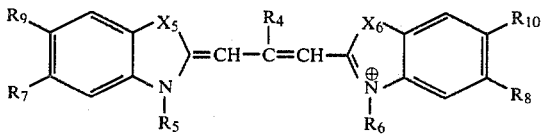

(III)

wherein $X_5$ and $X_6$ may be the same or different, and are each a sulfur atom or a selenium atom;

$R_4$ is an ethyl group, a propyl group, a butyl group, or a phenethyl group;

$R_5$ and $R_6$ are each a sulfoalkyl group containing from 2 to 4 carbon atoms, a carboxyalkyl group containing from 2 to 5 carbon atoms, a hydroxyalkyl group containing from 2 to 6 carbon atoms, an unsubstituted carbamoylalkyl group containing from 2 to 5 carbom atoms, or a lower alkyl group containing 6 or less carbon atoms (which may be substituted by a fluorine atom, a chlorine atom, an alkoxy group containing from 1 to 4 carbon atoms, a phenyl group, a sulfophenyl group, or a carboxyphenyl group), and at least one of $R_5$ and $R_6$ is a group containing a sulfo group or a carboxyl group;

$R_7$ and $R_8$ are each a hydrogen atom, a chlorine atom, a bromine atom, a lower alkyl group containing from 1 to 7 carbon atoms, a lower alkoxy group containing from 1 to 6 carbon atoms, a carboxyl group, a hydroxyl group, an alkoxycarbonyl group containing from 2 to 5 carbon atoms in total, an acylamino group wherein the number of carbon atoms in the acyl moiety is from 2 to 5, or a phenyl group (which may be substituted by a chlorine atom, a bromine atom, an alkyl group containing 4 or less carbon atoms, or an alkoxy group containing 4 or less carbon atoms);

$R_9$ and $R_{10}$ are each a hydrogen atom, a chlorine atom, a bromine atom, a lower alkyl group containing from 1 to 7 carbon atoms, a lower alkoxy group containing from 1 to 6 carbon atoms, a hydroxyl group, or an acylamino group wherein the number of carbon atoms in the acyl moiety is from 2 to 5.

9. A process for producing a silver halide color light-sensitive material as claimed in claim 1, wherein the compound represented by the general formula (II) is a compound selected from the group of compounds represented by the general formulae (IV) and (V):

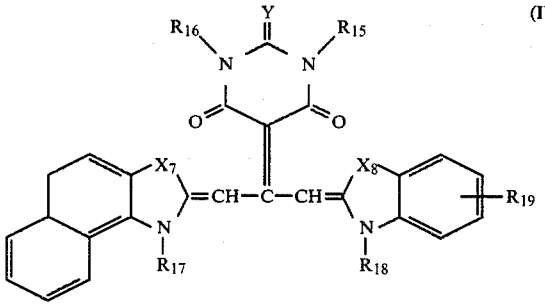

(IV)

-continued

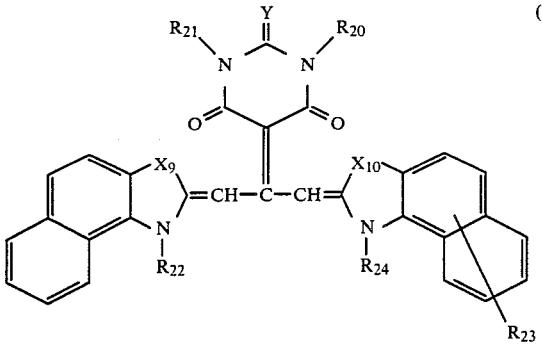

(V)

wherein

Y is an oxygen atom or a sulfur atom;

$R_{15}$, $R_{16}$, $R_{20}$ and $R_{21}$ are each a lower alkyl group containing from 1 to 6 carbon atoms (which may be substituted by a lower alkoxy group containing from 1 to 4 carbon atoms, a chlorine atom, a fluorine atom, or a phenyl group);

$R_{17}$, $R_{18}$, $R_{22}$ and $R_{24}$ are each a sulfoalkyl group containing from 2 to 4 carbon atoms, a carboxyalkyl group containing from 2 to 5 carbon atoms, a hydroxyalkyl group containing from 2 to 6 carbon atoms, an unsubstituted carbamoylalkyl group containing from 2 to 5 carbon atoms, or a lower alkyl group containing 6 or less carbon atoms (which may be substituted by a fluorine atom, a chlorine atom, an alkoxy group containing from 1 to 4 carbon atoms, a phenyl group, or a sulfophenyl group);

$R_{19}$ and $R_{23}$ are each a hydrogen atom, a chlorine atom, a bromine atom, a lower alkyl group containing from 1 to 7 carbon atoms, a lower alkoxy group containing from 1 to 6 carbon atoms, a carboxyl group, a hydroxyl group, an alkoxycarbonyl group containing 2 to 5 carbon atoms in total, an acylamino group wherein the number of carbon atoms in the acyl moiety is from 2 to 5, or a phenyl group (which may be substituted by a chlorine atom, a bromine atom, an alkyl group containing 4 or less carbon atoms, or an alkoxy group containing 4 or less carbon atoms);

$R_{17}$, $R_{18}$, $R_{22}$ and $R_{24}$ may be the same or different;

$R_{15}$, $R_{16}$, $R_{20}$ and $R_{21}$ may be the same or different;

$X_7$, $X_8$, $X_9$, and $X_{10}$ may be the same or different, and are each a sulfur atom or a selenium atom.

10. A process for producing a silver halide color light-sensitive material as claimed in claim 1, wherein the compound represented by the general formula (I) is present in an amount in the range of $10^{-6}$ to $10^{-3}$ mol per mole of silver halide and wherein the molar ratio of the compound of general formula (II) to the compound of general formula (I) is in the range of 1:5 to 1:100.

11. A process for producing a silver halide color light-sensitive material as claimed in claim 10, wherein the molar ratio of the compound of general formula (II) to the compound of general formula (I) is in the range of 1:10 to 1:50.

12. A process for producing a silver halide color light-sensitive material as claimed in claim 1, wherein the surface low iodine type silver iodobromide has a mean grain size of from 0.1 to 2.0$\mu$.

13. A process for producing a silver halide color light-sensitive material as claimed in claim 1, wherein on the surface of the surface low iodine type silver iodobromide grains is adsorbed from $10^{-6}$ to $10^{-3}$ mol of iodide ion per mole of silver halide.

14. A process for producing a silver halide color light-sensitive material as claimed in claim 13, wherein on the surface of the surface low iodine type silver iodobromide grains is adsorbed from $10^{-6}$ to $10^{-4}$ mol of iodide ion per mol of silver halide.

* * * * *